US007059763B2

(12) United States Patent
Sordelli et al.

(10) Patent No.: US 7,059,763 B2
(45) Date of Patent: Jun. 13, 2006

(54) GYROSCOPIC MIXER

(75) Inventors: Paolo Sordelli, Milan (IT); Sergio Szabo Miszenti, Novara (IT)

(73) Assignees: Fast & Fluid Management, S.R.I., Cinisello Balsano (IT); Fluid Management, Inc., Wheeling, IL (US)

( * ) Notice: Subject to any disclaimer, the term of this patent is extended or adjusted under 35 U.S.C. 154(b) by 116 days.

(21) Appl. No.: 10/691,398

(22) Filed: Oct. 22, 2003

(65) Prior Publication Data

US 2005/0088911 A1 Apr. 28, 2005

(51) Int. Cl.
*B01F 9/00* (2006.01)

(52) U.S. Cl. ..... 366/217; 366/605

(58) Field of Classification Search ..... 366/54, 366/55, 63, 213, 214, 217, 219, 220, 605
See application file for complete search history.

(56) References Cited

U.S. PATENT DOCUMENTS

| | | | | |
|---|---|---|---|---|
| 1,292,127 | A * | 1/1919 | Stevens | 366/217 |
| 1,594,516 | A * | 8/1926 | Derosha | 134/150 |
| 3,880,408 | A * | 4/1975 | Karjalainen | 366/217 |
| 4,445,782 | A * | 5/1984 | Sparrow, Jr. | 366/217 |
| 4,586,292 | A * | 5/1986 | Carroll et al. | 451/329 |
| 5,197,802 | A | 3/1993 | Miller et al. | |
| 5,501,522 | A * | 3/1996 | Tung | 366/219 |
| 5,788,371 | A * | 8/1998 | Neri et al. | 366/217 |
| 6,390,663 | B1 * | 5/2002 | Civardi | 366/217 |
| 2001/0038573 | A1 * | 11/2001 | Knight | 366/141 |
| 2005/0018535 | A1 * | 1/2005 | Miller | 366/217 |

FOREIGN PATENT DOCUMENTS

| | | |
|---|---|---|
| DE | 2809513 A1 | 9/1979 |
| DE | 3111437 A1 | 10/1982 |
| DE | 9407810 | 9/1994 |
| DE | 4416593 C1 | 9/1995 |
| EP | 0478212 A1 | 4/1992 |
| EP | 0796652 A1 | 9/1997 |
| EP | 0955081 A1 | 11/1999 |
| WO | WO91/08045 | 6/1991 |

OTHER PUBLICATIONS

European Search Report dated Nov. 21, 2005.

* cited by examiner

*Primary Examiner*—David Sorkin
(74) *Attorney, Agent, or Firm*—Miller, Matthias & Hull

(57) ABSTRACT

A gyroscopic mixer is disclosed which features a direct drive connection to a motor and a clamping mechanism which enables the mixer to accommodate containers of various sizes and configurations. The motor is connected to a drive shaft which is connected to a first bracket. The motor imparts rotation to the bracket about a first axis. An annular gear and single pulley belt is utilized to impart rotation about a second axis that is substantially perpendicular to the first axis for a gyroscopic mixing motion.

12 Claims, 3 Drawing Sheets

GYROSCOPIC MIXER

TECHNICAL FIELD

A gyroscopic mixer for mixing the contents of a closed container is disclosed. More specifically, a gyroscopic paint mixer is disclosed which is capable of accommodating newer paint containers having a cubicle body, integrated handle and top equipped with a pour spout. The mixer includes a direct drive between a motor and a bracket that rotates the container about a first axis that extends transversely through the container. Further, only a single belt is utilized for rotating the container about a second axis extending longitudinally through the lid of the container to therefore impart gyroscopic rotation to the container.

BACKGROUND OF THE RELATED ART

Mixing of various materials, for example paint, has heretofore been affected by manually mixing or agitating the material, such as by stirring or shaking. For example, U.S. Pat. No. 3,894,723 is directed to a mechanical agitator, while U.S. Pat. Nos. 1,908,561 and 3,265,366 disclose paint shaking devices. The mixing action is relatively slow and inefficient in these devices. Material shaking devices, such as paint shakers, require substantial mechanical structure and a heavy base or anchoring since vibration is a major problem. Due to vibration and the force of the material on the lid of the container, a cumbersome clamping apparatus must be employed to tightly retain the lid in position during the shaking operation. U.S. Pat. Nos. 2,599,833 and 2,894,309 disclose clamping apparatuses for use with containers in shaking devices.

Others achieve mixing by accelerating material in a container first in one direction and then in a second opposite direction to achieve mixing by the combination of shear forces and the creation and destruction of a vortex in the material. A mixer of this type is shown in U.S. Pat. No. 3,542,344. While a mixer of this type reduces the problems of vibration and eliminates the necessity to clamp the lid on the container, substantial power and braking apparatus are required to effect the acceleration and reversal of the material in the container.

Another type of mixer spins the container in one direction and oscillates the container at the same time. An example of this type of device is disclosed in U.S. Pat. No. 3,181,841. This type of device also requires a complicated mechanical structure, disadvantageously causes vibration and requires clamping of the lid or cover of the container.

Still another type of mixing apparatus simultaneously spins a container of material about two perpendicular axes, or gyroscopically. U.S. Pat. No. 3,880,408 discloses a device in which the container is rotated continuously about the two axes, whereas U.S. Pat. No. 3,706,443 discloses apparatus which rotates the container continuously about one axis but only rocks about a second, perpendicular axis by gyroscopic forces due to imbalance in the system. While the resulting mixing action is relatively rapid, a complicated mechanical structure is required and, because of the vibration, the lid must be securely clamped to the container.

Another type of gyroscopic mixer which has become a standard in the paint industry is disclosed in U.S. Pat. No. 4,235,553. The mixer simultaneously rotates the fluid container in one direction about a first axis and simultaneously rotates the container about a second axis which is non-perpendicular to the first axis. The rotation of the container about two different, non-perpendicular axes results in efficient bottom circulation of the fluid material within the container.

At least two problems associated with the gyroscopic-type mixers disclosed in the '408, '443 and '553 patents relate to the drive mechanisms and the supporting structure for holding the fluid container. First, the supporting structures are typically fixed in size and unable to accommodate containers that are smaller or larger than the standard cylindrically-shaped paint can. A second problem associated with these devices lies in the drive mechanism. Specifically, the complicated belt arrangement is typically required between the supporting structure that holds the fluid container and the motor. The belts are prone to wear and are difficult to replace.

Accordingly, there is a need for an improved mixer for fluid materials and suspensions which is capable of accommodating containers of different and varying sizes and shapes and which provides the benefits of gyroscopic mixing but with an improved, more efficient and simplified drive mechanism.

SUMMARY OF THE DISCLOSURE

In satisfaction of the aforenoted needs, an improved gyroscopic mixer is disclosed which comprises a motor coupled to a bracket. The motor imparts rotational movement to the bracket about a first axis. The bracket is rotatably connected to a pulley gear that is enmeshed with a stationary annular gear that, in turn, is concentric about the first axis and which defines a circular path about the first axis. The pulley gear moves along the circular path as the bracket rotates about the first axis. The pulley gear is connected to a drive pulley. The pulley gear and drive pulley define a second axis. The pulley gear and drive pulley about the second axis as the pulley gear moves along the circular path of the annular gear. The bracket is also rotatably connected to a driven pulley. The drive and driven pulleys are coupled together. The bracket is also rotatably connected to a clamp assembly that is rotatably coupled to a driven platform. The driven pulley is connected to a drive platform. The driven pulley, drive platform and driven platform are all disposed along a third axis. The clamp assembly is capable of adjusting an axial spacing between the driven and drive platforms and providing a clamping force on a container disposed therebetween. The spinning of the pulley gear and drive pulley about the second axis results in a spinning of the driven pulley, drive platform and driven platform about the third axis.

In a refinement, the drive and driven pulleys are coupled together by an endless belt. In such a refinement, the belt coupling the drive and driven pulleys is only the belt used in the mixer design. In a further refinement of this concept, the endless belt is a toothed endless and the drive and driven pulleys each comprise a plurality of slots for receiving the teeth of the endless belt.

In another refinement, the motor is coupled to the bracket by a drive shaft assembly. In such a refinement, the drive shaft assembly may comprise a primary drive shaft connected to the motor and a secondary drive shaft connected to the bracket. The primary and secondary drive shafts may be coupled together with a flexible bushing disposed therebetween.

In another refinement, the bracket is c-shaped with a generally vertical middle arm disposed between generally horizontal first and second arms. The middle arm is connected to the motor and the first arm is connected to the clamp assembly and supports the driven platform. The second arm rotatably supports the drive and driven pulleys and the drive platform. In such a refinement, the pulley gear may be supported by the middle arm and may be connected to the drive pulley by a generally vertical shaft that is parallel to the middle arm. In such a refinement, the generally vertical shaft may be embedded within the middle arm.

In another refinement, the clamp assembly comprises a threaded shaft threadably connected to a first arm of the bracket and which is fixedly connected to a clamp member. The clamp member is rotatably connected to the driven platform so that rotation of the threaded shaft adjusts the distance between the drive and driven platforms for generating the clamping force therebetween but leaving the drive and driven platforms free to rotate about the third axis.

In another refinement, the motor is coupled to the bracket by a drive shaft that passes through a casing. The casing comprises an annular flange that is connected to and supports the annular gear.

In another refinement, the mixer further comprises a housing with an opening providing access to the clamp assembly and drive and driven platforms. The housing also comprises a bottom panel. The mixer further comprises a wedge support disposed beneath the bottom panel of the housing to support the mixer so that the second and third axes are not vertical and so that the first axis is not horizontal. In short, the mixer is tilted backwards for easy access and manipulation by the user.

BRIEF DESCRIPTION OF THE DRAWINGS

The disclosed mixers are shown more or less diagrammatically in the accompanying drawings wherein.

It should be understood that the drawings are not necessarily to scale and that the embodiments are sometimes illustrated by phantom lines, diagrammatic representations and fragmentary views. In certain instances, details which are not necessary for an understanding of the disclosed mixing devices or which render other details difficult to perceive may have been omitted. It should be understood, of course, that the disclosed mixes are not necessarily limited to the particular embodiments illustrated herein.

DETAILED DESCRIPTION OF THE PRESENTLY PREFERRED EMBODIMENTS

Figure 1:
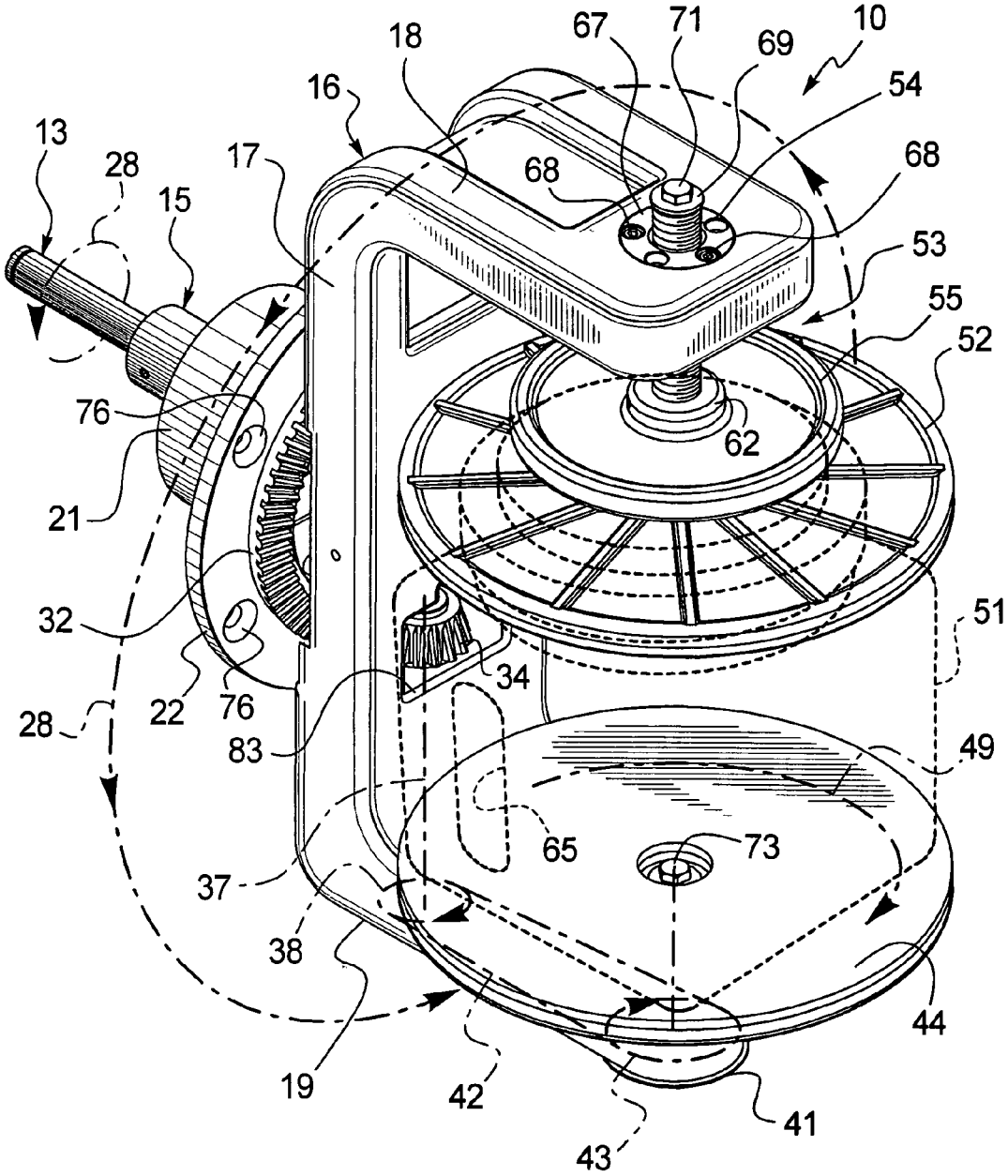
FIG. 1 is a partial perspective view of a gyroscopic mixer made in accordance with this disclosure.
Figure 2:
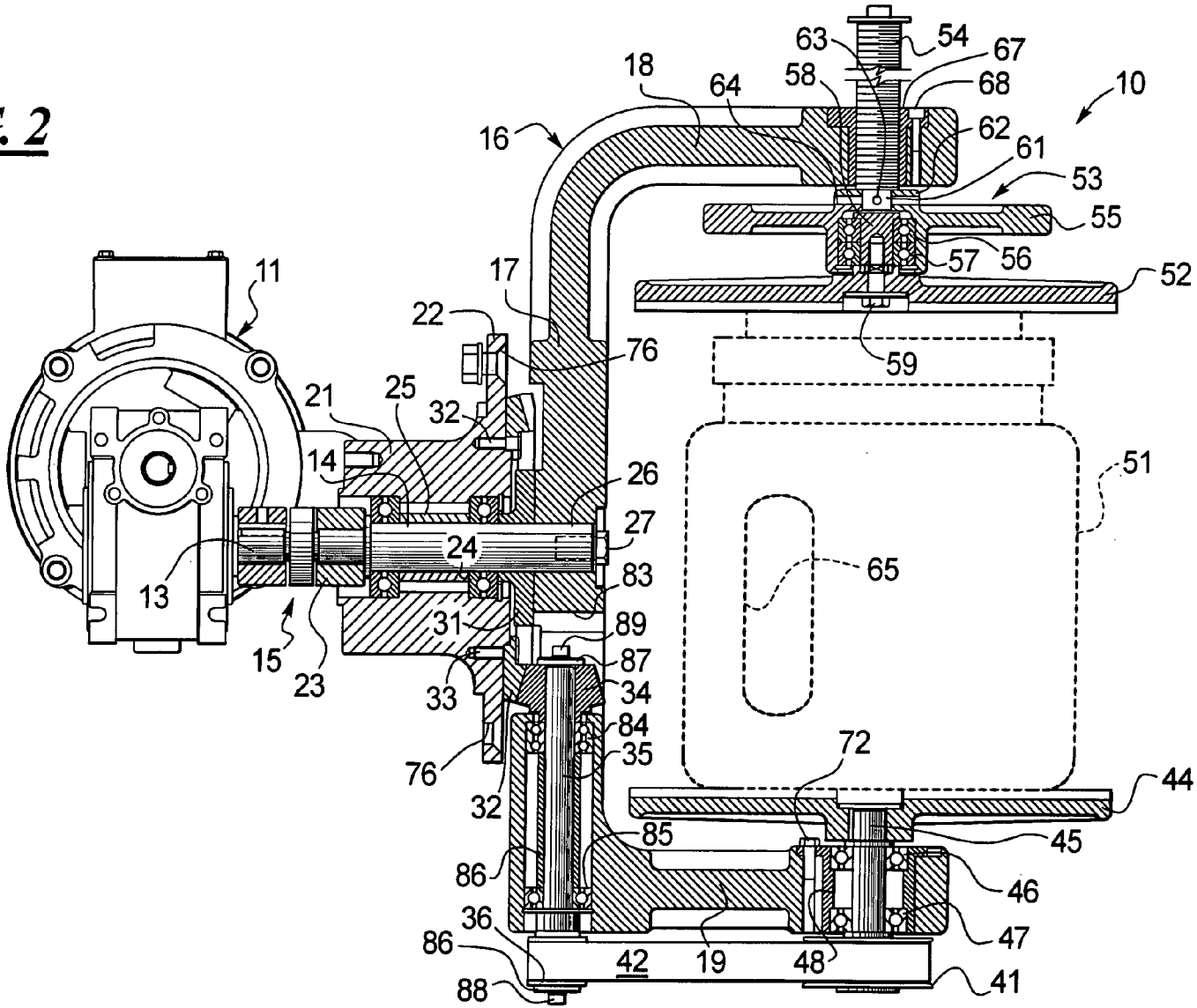
FIG. 2 is a side sectional view of the mixer shown in FIG. 1.

In FIG. 1, a mixer 10 is illustrated in part because the motor 11 (see FIG. 2) and cabinet 12 (see FIGS. 3 and 4) are not shown. Referring to FIGS. 1 and 2 together, the mixer includes a primary drive shaft 13 which is coupled to a secondary drive shaft 14 by a flexible coupling element 15 that is commercially available and known to those skilled in the art. The secondary drive shaft 14 is connected to a c-shaped bracket 16 which includes a vertical middle arm 17 disposed between an upper or first arm 18 and a lower of second arm 19. The secondary drive shaft passes through a casing 21 which is connected to an annular flange 22. The casing 21 supports a pair of bearings 23, 24 through which the drive shaft 14 passes. A bushing 25 is disposed between the bearings 23, 24 as shown in FIG. 2. The distal end 26 of the drive shaft 14 is connected to the middle arm 17 of the bracket 16 by way of the bolt 27 or other suitable attachment mechanism. The fixed connection between the drive shaft 14 and the bracket 16 results in rotation of the bracket 16 about the axis of the drive shafts 13, 14 or in the direction of the arrows 28 shown in FIG. 1. Of course, an opposite rotation would also be possible, depending upon the design of the motor 11.

The drive shaft 14 may also pass through a thrust or bearing washer such as the one shown at 31 in FIG. 2. The annular flange 22 is connected to and supports an annular gear 32. The annular gear 32 may be connected to the flange 22 by threaded fasteners, such as those shown at 33 or another suitable attachment mechanism. The annular gear 32 is enmeshed with a beveled gear 34 which is disposed within the middle arm 17 of the bracket 16. The beveled gear 34 is connected to a shaft 35 which, in turn, is connected to a drive pulley 36.

As the c-shaped bracket 16 rotates about the common axis of the drive shafts 13, 14 and in direction of the arrow 28 of FIG. 1, the beveled gear 34 follows the orbital path of the annular gear 32 and in turn rotates about its common axis with the shaft 35 and drive pulley 36. This axis is labeled 37 in FIG. 1 and the rotation is indicated by the arrow 38 in FIG. 1. Thus, rotation of the bracket 16 and the direction of the arrow 28 results in rotation of the drive pulley 36 in the direction of the arrow 38.

The drive pulley 36 is coupled to a driven pulley 41 by an endless belt 42. The endless belt 42 may be a toothed belt and the pulleys 36, 41 may, in turn, include grooves for receiving the teeth or ribs disposed on an interior surface of the belt 42. A standard pulley and belt arrangement may also be utilized. Thus, rotation of the drive pulley 36 in the direction of the arrow 38 results in rotation of the driven pulley 41 and direction of the arrow 43 as shown in FIG. 1.

The driven pulley 41 is fixedly connected to a drive platform 44 by way of the shaft 45. The shaft 45 passes through the lower or second arm 19 of the bracket 16 and is supported by a pair of bearings 46, 47 and an annular bushing 48. Thus, rotation of the pulleys 36, 41 results in rotation of the drive platform 44 in the direction of the arrow 49.

The drive platform 44 provides support for one end of the container shown in phantom at 51. The container 51 is sandwiched between the drive platform 44 and the driven platform 52. The driven platform 52 is connected to the first or upper arm 18 of the bracket 16 by way of the clamp mechanism 53. The clamp mechanism 53 includes a threaded shaft 54 that is threadably received in the upper arm 18 of the bracket 16. The shaft 54 is fixedly connected to the clamp member 55, which, in turn, is rotatably connected to the driven platform 52. The driven platform 52 is free to rotate with respect to the clamp member 55 by way of its support by the bearings 56, 57 which receive the shaft 58 that is connected to the driven platform 52 by way of the bolt 59 or other suitable attachment mechanism. The shaft 54, in turn, is fixedly connected to the client member 55 by way of the shaped stud 61 that fits within a correspondingly shaped hole in the upper end 62 of the client member 55. The stud 61 may also be equipped with a pin or spring-biased bead 63 for receipt within corresponding holes shown at 64 in the upper end 62 of the clamp member 55.

The driven platform 52 and drive platform 44 may be clamped together with the container 51 clamped therebetween by rotating the clamp member 55. Also, a handle (not shown) may be mounted to the upper end of the shaft 54.

The clamping mechanism 53 enables the mixer 10 to accommodate containers 51 of various sizes. The design is particularly advantageous to the cubicle-shaped containers 51 with handle openings 65 that are currently being marketed by paint manufacturers.

In the embodiment illustrated in FIGS. 1 and 2, the threaded shaft 54 is received within a threaded bushing 67 that is connected to the arm 18 of the bracket 16 by way of the bolts or fasteners shown at 68. A washer 69 and bolt 71 are disposed at the upper end of the shaft 54 to prevent the upper end of the shaft 54 from being screwed down into the bushing 67. Similarly, the bushing 48 that supports the bearings 46, 47 in the lower arm 19 is also connected to the lower arm 19 by a plurality of fasteners, one of which is shown at 72. The shaft 45 is fixedly connected to the drive platform 44 by a bolt or fastener shown at 73.

Figure 4:
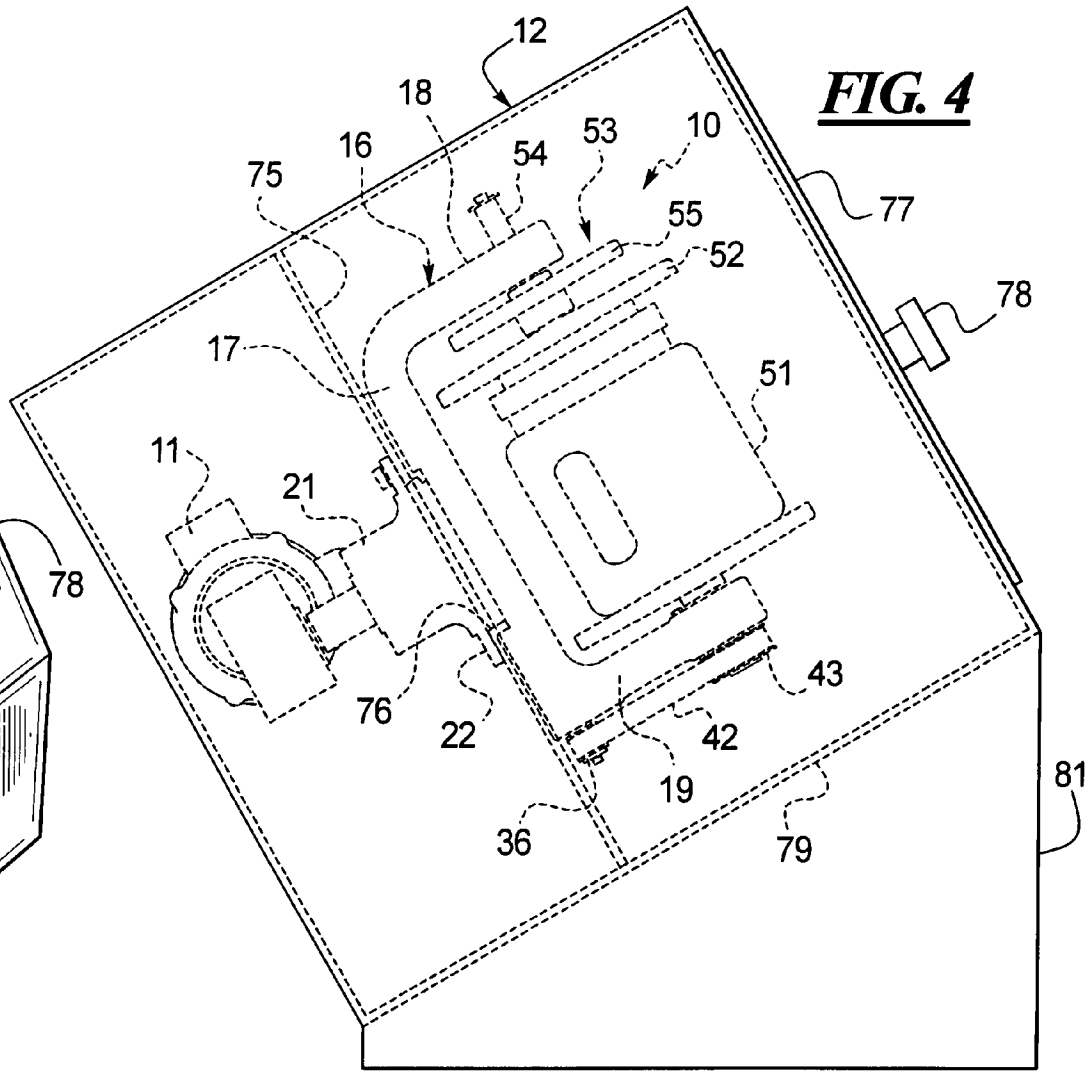
FIG. 4 is a side plan view of the cabinetry shown in FIG. 3 with the mixer enclosed therein shown in phantom.
Figure 3:
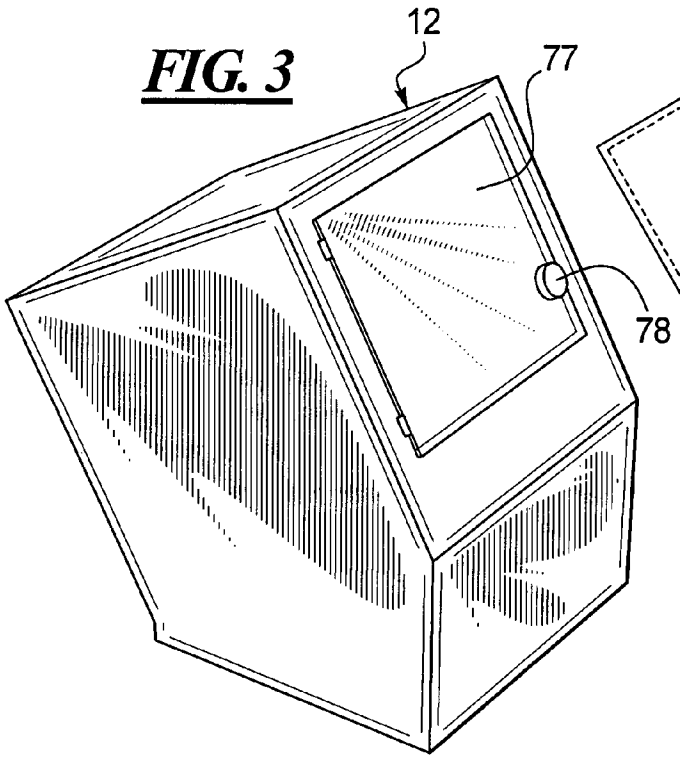
FIG. 3 is a perspective view of the enclosing cabinetry for the mixer shown in FIGS. 1 and 2.

Turning to FIGS. 3 and 4, the mixer 10 is housed within a cabinet 12. The casing 21 is connected to the wall 75 by way of the flange 22 being bolted into place using the threaded openings shown at 76 in FIGS. 1 and 2. The wall 75 includes an opening 76 which encircles the annular gear 32. The cabinet 12 also includes a door 77 with a handle 78 that provides access to the mixer 10. Preferably, the bottom panel 79 of the cabinet 12 is supported by a wedge structure 81 which tilts the mixer as shown in FIGS. 3 and 4 to provide easier access when the entire apparatus is supported on the floor. The wedge 81 can tilt the mixer at varying angles of convenience ranging from about 5 to about 30 degrees. The wedge 81 may be a separate component from the cabinet 12 or may an integral part of the cabinet 12 as shown in FIG. 3.

Returning to FIG. 1, it will be noted that the beveled gear 34 can be accommodated in an opening 83 within the middle arm 17 and, as shown in FIG. 2, the shaft 35 may extend down through the middle 17 to provide a compact design. The shaft 35 is also supported by the bearings 84, 85 and the bushing 86. The freely rotating shaft 35 is also held in place by the washers 86, 87 and bolts or fasteners 88, 89.

Thus, an improved gyroscopic mixer 10 is disclosed which rotates the container 51, containing a liquid slurry such as paint, gyroscopically in the rotational directions shown by the arrows 28 and 49. The compact design provides a direct drive connection to a motor 11 and uses only a single endless belt 42.

While only certain embodiments have been set forth, alternative embodiments and various modifications will be apparent from the above description to those skilled in the art. These and other alternatives will be considered equivalents and within the spirit and scope of this disclosure.

What is claimed is:

1. A gyroscopic mixer for mixing the contents of a closed container, the mixer comprising:

a motor coupled to a c-shaped bracket with an open front and with a generally vertical middle arm disposed between generally horizontal first and second arms, the middle arm being connected to the motor, the motor imparting rotational movement to the bracket about a first axis, the middle arm of the bracket comprising a slot for accommodating a pulley gear that is enmeshed with a stationary annular gear that is concentric about the first axis and which defines a circular gear path about the first axis, the pulley gear moving along the circular gear path as the bracket rotates about the first axis, the pulley gear being connected to a drive pulley by a pulley shaft that passes through and is at least partially rotatatably supported within the middle arm, the pulley gear, pulley shaft and drive pulley defining a second axis, the pulley gear and drive pulley spinning about the second axis as the pulley gear moves along the circular gear path of the annular gear, the second arm of the bracket being rotatively connected to a driven pulley, the drive and driven pulleys being coupled together by an endless belt disposed below the second arm, the first arm of the bracket being rotatively connected to a clamp assembly with the first arm rotatively coupled to a driven platform, the driven pulley and the second arm being connected to a drive platform, the driven pulley, drive platform and driven platform being disposed along a third axis, the clamp assembly being capable of adjusting an axial spacing between the driven and drive platforms and providing a clamping force on the container when disposed therebetween, the spinning of the pulley gear and drive pulley about the second axis resulting in spinning of the driven pulley, drive platform and driven platform about the third axis.

2. The mixer of claim 1 wherein the endless belt is a toothed endless belt and the drive and driven pulleys each comprise a plurality of slots for receiving teeth of the endless belt.

3. The mixer of claim 1 wherein the motor is coupled to the bracket by a drive shaft assembly.

4. The mixer of claim 3 wherein the drive shaft assembly comprises a primary drive shaft connected to the motor and a secondary drive shaft connected to the bracket, the primary and secondary drive shafts being coupled together with a flexible bushing disposed therebetween.

5. The mixer of claim 1 wherein the clamp assembly comprises a threaded shaft threadably connected to the first arm of the bracket and fixedly connected to a clamp member, the clamp member being rotatively connected to the driven platform.

6. The mixer of claim 1 wherein the motor is coupled to the bracket by a drive shaft that passes through a casing, the casing comprising an annular flange that is connected to the annular gear.

7. The mixer of claim 1 further comprising a housing with an opening providing access to the clamp assembly and drive and driven platforms, the housing also comprising a bottom panel, the mixer further comprising a wedge support disposed beneath the bottom panel of the housing to support the mixer so that the second and third axes are not vertical and the first axis is not horizontal.

8. A gyroscopic mixer for mixing the contents of a closed container, the mixer comprising:

a motor, a c-shaped bracket with an open front comprising a middle leg disposed between a first leg and a second leg, the first leg being connected to a clamp assembly, the second leg being connected to a driven pulley, the motor being directly coupled to the middle leg of the bracket by a drive shaft assembly that imparts rotational movement to the bracket about a first axis without a pulley, the drive shaft assembly passing through a casing that is disposed between the motor and bracket, the casing comprising an annular flange that faces the bracket and which is connected to a stationary annular gear set that also faces the bracket and which is concentric about the first axis, the bracket being rotatively connected to a pulley gear that is enmeshed with the annular gear set, the pulley gear moving along the annular gear as the bracket rotates about the first axis, the pulley gear being disposed within a recess in the middle arm, the pulley gear being connected to a drive pulley by pulley shaft that passes through and is accommodated in the middle arm, the pulley gear, pulley shaft and drive pulley defining a second axis, the pulley gear, pulley shaft and drive pulley spinning about the second axis as the pulley gear moves along the circular gear path of the annular gear, the drive and driven pulleys being coupled together by a toothed endless belt disposed below the second arm, the drive and driven pulleys each comprise a plurality of slot for receiving teeth of the endless belt, the clamp assembly being rotatively coupled to a driven platform, the driven pulley being connected to a drive platform, the driven pulley, drive platform and driven platform being disposed along a third axis, the clamp assembly being capable of adjusting an axial spacing between the driven and drive platforms and providing a clamping force on the container when disposed therebetween, the spinning of the pulley gear and drive pulley about the second axis resulting in spinning of the driven pulley, drive platform and driven platform about the third axis.

9. The mixer of claim 8 wherein the drive shaft assembly comprises a primary drive shaft connected to the motor and a secondary drive shaft connected to the bracket, the primary and secondary drive shafts being coupled together with a resilient bushing disposed therebetween.

10. The mixer of claim 8 wherein the clamp assembly comprises a threaded shaft threadably connected to the first arm of the bracket and fixedly connected to a clamp member, the clamp member being rotatively connected to the driven platform.

11. The mixer of claim 8 wherein further comprising a housing with an opening providing access to the clamp assembly and drive and driven platforms, the housing also comprising a bottom panel, the mixer further comprising a wedge support disposed beneath the bottom panel of the housing to support the mixer so that the second and third axes are not vertical and the first axis is not horizontal.

12. A gyroscopic mixer for mixing the contents of a closed container, the mixer comprising:

a motor, a c-shaped bracket with an open front comprising a middle arm disposed between a first arm and a second leg, the first leg being connected to a clamp assembly, the second arm being connected to a driven pulley, the motor being directly coupled to the middle arm of the bracket by a drive shaft assembly that imparts rotational movement to the bracket about a first axis without a pulley, the drive shaft assembly passing through a casing that is disposed between the motor and bracket, the casing comprising an annular flange that faces the bracket and which is connected to a stationary annular gear set that also faces the bracket and which is concentric about the first axis, the bracket being rotatively connected to a pulley gear that is enmeshed with the annular gear set, the pulley gear moving along the annular gear as the bracket rotates about the first axis, the pulley gear being accommodated in a recess of the middle arm, the pulley gear being connected to a drive pulley by pulley shaft, the pulley shaft being accommodated in a slot disposed in the middle arm, the pulley gear, pulley shaft and drive pulley defining a second axis, the pulley gear, pulley shaft and drive pulley spinning about the second axis as the pulley gear moves along the circular gear path of the annular gear, the drive and driven pulleys being coupled together by a toothed endless belt, the clamp assembly comprising a threaded shaft threadably connected to the first arm of the bracket and fixedly connected to a clamp member, the clamp member being rotatively connected to a driven platform, the driven pulley being connected to a drive platform, the driven pulley, drive platform and driven platform being disposed along a third axis, the clamp assembly being capable of adjusting an axial spacing between the driven and drive platforms and providing a clamping force on the container when disposed therebetween, the spinning of the pulley gear and drive pulley about the second axis resulting in spinning of the driven pulley, drive platform and driven platform about the third axis, and a housing with an opening providing access to the clamp assembly and drive and driven platforms, the housing also comprising a bottom panel, the mixer further comprising a wedge support disposed beneath the bottom panel of the housing to support the mixer so that the second and third axes are not vertical and the first axis is not horizontal.

* * * * *